US008695140B1

(12) United States Patent
Zyadet

(10) Patent No.: US 8,695,140 B1
(45) Date of Patent: Apr. 15, 2014

(54) PORTABLE RAMP ASSEMBLY

(71) Applicant: John G. Zyadet, Phoenix, AZ (US)

(72) Inventor: John G. Zyadet, Phoenix, AZ (US)

( * ) Notice: Subject to any disclaimer, the term of this patent is extended or adjusted under 35 U.S.C. 154(b) by 0 days.

(21) Appl. No.: 13/679,097

(22) Filed: Nov. 16, 2012

(51) Int. Cl.
*E01D 15/00* (2006.01)

(52) U.S. Cl.
USPC ..... 14/69.5

(58) Field of Classification Search
USPC ..... 14/69.5; 193/38, 41, 2 A; 16/268, 266, 16/252, 254, DIG. 43; 52/71, 108, 587.1; 403/364, 157, 159; 414/537; 198/860.2, 735.2, 861.2, 861.5; 104/35, 275
See application file for complete search history.

(56) References Cited

U.S. PATENT DOCUMENTS

| | | | | | |
|---|---|---|---|---|---|
| 426,209 | A * | 4/1890 | McIntyre | 14/69.5 |
| 1,358,951 | A * | 11/1920 | Helmich | 405/221 |
| 1,412,881 | A * | 4/1922 | Ledwinka | 16/270 |
| 2,313,724 | A * | 3/1943 | Adler | 40/618 |
| 2,618,124 | A * | 11/1952 | Holsten | 405/220 |
| 2,643,010 | A * | 6/1953 | Ion et al. | 414/584 |
| 2,687,617 | A * | 8/1954 | Newell | 405/221 |
| 3,020,083 | A * | 2/1962 | Doan et al. | 296/24.31 |
| 3,074,239 | A * | 1/1963 | Mustard | 405/221 |
| 3,329,984 | A * | 7/1967 | Akers | 14/71.5 |
| 3,966,245 | A * | 6/1976 | Losenno | 292/202 |
| 3,984,891 | A * | 10/1976 | Weinmann | 14/69.5 |
| 4,126,006 | A * | 11/1978 | Lewis | 405/220 |
| 4,341,371 | A * | 7/1982 | Rotella | 254/88 |
| 4,468,901 | A * | 9/1984 | Henderson et al. | 52/79.6 |
| 4,683,833 | A * | 8/1987 | Meriwether | 114/267 |
| 4,726,155 | A * | 2/1988 | Nahmias | 52/71 |
| 4,807,317 | A * | 2/1989 | Quinn et al. | 14/69.5 |
| 4,945,595 | A * | 8/1990 | Meriweather | 14/69.5 |
| 5,740,575 | A * | 4/1998 | Gordon | 14/69.5 |
| 5,788,416 | A * | 8/1998 | Wolgamot | 405/218 |
| 5,794,292 | A | 8/1998 | Ricci, Jr. | |
| 5,870,788 | A | 2/1999 | Witkin | |
| 6,217,259 | B1 * | 4/2001 | Godbersen | 405/218 |
| 6,481,036 | B1 | 11/2002 | Duvall | |
| 6,526,614 | B2 * | 3/2003 | Anderson et al. | 14/69.5 |
| 6,898,815 | B2 | 5/2005 | Young | |
| 7,213,285 | B2 * | 5/2007 | Mitchell | 14/69.5 |
| 7,216,391 | B2 * | 5/2007 | Muhl et al. | 14/71.1 |
| 7,240,388 | B2 * | 7/2007 | Warford | 14/69.5 |
| 7,454,811 | B1 * | 11/2008 | Stotka | 14/69.5 |
| 8,286,290 | B2 * | 10/2012 | Kim | 14/69.5 |
| 8,370,982 | B2 * | 2/2013 | Peters | 14/69.5 |
| 2002/0078513 | A1 * | 6/2002 | Schouest | 14/69.5 |
| 2004/0133998 | A1 | 7/2004 | Sloniker et al. | |
| 2005/0123380 | A1 | 6/2005 | Massaro | |
| 2010/0282418 | A1 * | 11/2010 | Lucas | 160/54 |
| 2012/0286224 | A1 * | 11/2012 | Duffy et al. | 256/22 |
| 2013/0055511 | A1 * | 3/2013 | McGivern et al. | 14/69.5 |

* cited by examiner

*Primary Examiner* — Thomas B Will
*Assistant Examiner* — Jessica H Lutz
(74) *Attorney, Agent, or Firm* — Thomas W. Galvani, P.C.; Thomas W. Galvani

(57) ABSTRACT

A ramp assembly includes a ramp, a landing, a side railing, and a corner railing, and a bridge mounted to and extending from the landing. The ramp is pivotably and releasably coupled to the landing for configuration of the ramp assembly between an operational condition and a storage condition. In the operational condition, the ramp assembly is placed on the road proximate to a sidewalk curb, the ramp is coupled to the landing, the side railing is coupled to the ramp, the corner railing is coupled to the landing, and the bridge extends outwardly from the landing, in a direction transverse to the ramp, and onto the curb to form a continuous walking surface between the road and the sidewalk. In the storage condition, the ramp, landing, side railing, and corner railing are decoupled from each other and stored.

17 Claims, 5 Drawing Sheets

PORTABLE RAMP ASSEMBLY

FIELD OF THE INVENTION

The present invention relates generally to ramps, and more particularly to portable ramp assemblies.

BACKGROUND OF THE INVENTION

Sidewalks degrade with time and use, and must occasionally be closed for repair. Construction crews will close a sidewalk in one of several ways. The crew may simply close the sidewalk without warning or notice, forcing people walking and in wheelchairs (herein together referred to as "pedestrian traffic") to cross the street, back track and go around the construction, or actually walk through the construction. The crews may also place warnings at proximate intersections, warning pedestrian traffic that the sidewalk ahead is closed and a sidewalk on the opposing side of the street may be available. The crews may also place plywood over or around the construction, so that pedestrian traffic can detour the construction. All of these methods are undesirable. Some involve directing pedestrian traffic into traffic lanes, which are generally only ten feet wide but can sometimes be narrower. Others involve temporary solutions which deteriorate with exposure to pedestrian traffic and environmental elements. Other permanent ramps are heavy and generally cannot be adapted to a range of uses, heights, and environments.

When a curb must be negotiated, a detour can present additional problems. Curbs present significant space requirements for detours. A curb 4 inches in rise requires 4 feet of run, and a curb 8 inches in rise requires 8 feet of run to transition pedestrian traffic over the curb. Further, most curbs are inclined out of the road, so that steps placed next to a curb still leave a gap between the step and the curb, posing a danger to wheelchairs, women in high heels, and others. An improved solution for detouring pedestrian traffic around a sidewalk under construction is needed.

SUMMARY OF THE INVENTION

According to the principle of the invention, a ramp assembly includes a ramp, a landing, a side railing, and a corner railing, and a bridge mounted to and extending from the landing. The ramp is pivotably and releasably coupled to the landing for configuration of the ramp assembly between an operational condition and a storage condition. In the operational condition, the ramp assembly is placed on the road proximate to a sidewalk curb, the ramp is coupled to the landing, the side railing is coupled to the ramp, the corner railing is coupled to the landing, and the bridge extends outwardly from the landing, in a direction transverse to the ramp, and onto the curb to form a continuous walking surface between the road and the sidewalk. The ramp is pivotably coupled to the landing to allow the ramp to be positioned at different heights with respect to the landing and form the continuous walking surface. In the storage condition, the ramp, landing, side railing, and corner railing are decoupled from each other and stored.

BRIEF DESCRIPTION OF THE DRAWINGS

Referring to the drawings.

DETAILED DESCRIPTION

Figure 1:
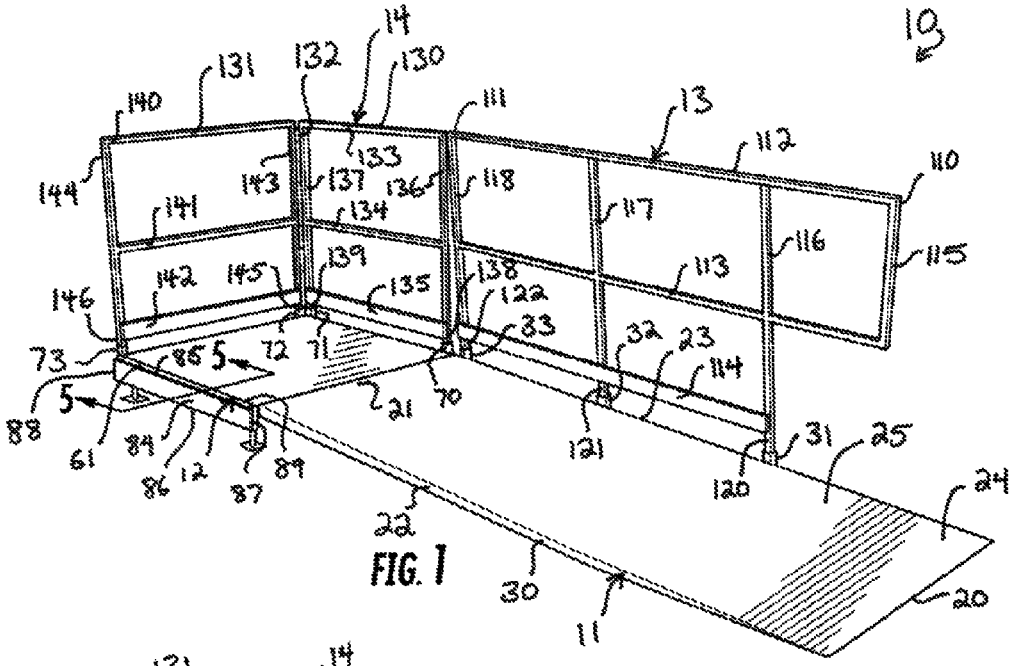
FIG. 1 is a front perspective view of a ramp assembly constructed and arranged in accordance with the principle of the invention, shown in an operational condition, and including a ramp, a landing, a side railing, and a corner railing.

Reference now is made to the drawings, in which the same reference numbers are used throughout the different figures to designate the same elements. FIG. 1 illustrates a ramp assembly 10 arranged and constructed according to the principle of the invention. The ramp assembly 10 includes a ramp 11, a landing 12, a side railing 13, and a corner railing 14. The ramp assembly 10 is configurable between an operational condition, as shown in FIG. 1, in which the ramp 11 is coupled to the landing 12, the side railing 13 is coupled to the ramp 11, and the corner railing 14 is coupled to the landing 12, and a storage condition, partially shown in FIG. 2, in which the ramp 11, the landing 12, the side railing 13, and the corner railing 14 are decoupled. In the operational condition, the ramp assembly 10 is useful for conveying pedestrian traffic between raised and lowered surfaces. In the storage condition, the ramp assembly 10 can be collected, storage, and transported for portability between job sites.

With continuing reference to FIG. 1, the ramp 11 includes a downstream end 20, an opposed upstream end 21 and opposed sides 22 and 23. A sheet 24 extends between the downstream and upstream ends 20 and 21 and between the sides 22 and 23, and includes an upper surface 25 and an opposed underside 26 (not shown in FIG. 1). The sheet 24 is large, rugged, and rectangular in shape, and is a walking or rolling surface for supporting pedestrian traffic passing over the ramp assembly 10 between the downstream and upstream ends 20 and 21 of the ramp 11. The sheet 24 is supported along the underside 26 by a rigid, structural framework 30 extending between the opposed downstream and upstream ends 20 and 21. The sheet 24 has a thin profile and is flat and elongate.

Three sockets 31, 32, and 33 are mounted to the side 23 between the downstream and upstream ends 20 and 21 opposite the sheet 25. With momentary reference to FIG. 2, the sockets 31, 32, and 33 are suspended away from the sheet 24 off of the side 23, and have openings extending into receiving spaces formed within the sockets 31, 32, and 33. Each of the sockets 31, 32, and 33 is vertically positioned on the side 23 so that tops of the sockets 31, 32, and 33 project above the upper surface 25, locating the openings above the upper surface 25 proximate to the side 23. The socket 31 is formed at a location generally intermediate between the downstream and upstream ends 20 and 21. The socket 33 is formed proximate to the upstream end 21 of the ramp 11. The socket 32 is formed at a location generally intermediate between the sockets 31 and 33. The openings are each square, and the receiving spaces are prismatic and correspond to the square openings.

The ramp 11 is releasably coupled to the landing 12 along the upstream end 21 of the ramp 11. An engagement assembly 40 carried between the ramp 11 and the landing 12 pivotably couples the ramp 11 to the landing 12. As the term is used here, "pivotably couples" means the engagement assembly couples the ramp 11 to the landing 12 and allows the ramp 11 to be pivoted with respect to the landing 12 while coupled. A piano hinge 41 carried on the ramp 11 defines an engagement element of the engagement assembly 40. The hinge 41 is shown in greater detail in FIG. 6 and FIG. 7A. The hinge 41 has a leaf 42 and an opposed leaf 43. Leaves 42 and 43 are formed with knuckles 44 and 45, respectively, which are enmeshed and joined with a pin 46 extending through the knuckles 44 and 45. The leaf 42 is permanently secured to the underside 26 of the sheet 24 as by welding, bolting, or other permanent fastening method, and as such, the leaf 43 pivots with respect to the leaf 42 and the sheet 24 about the pin 46 between an extended position projecting outwardly away from the sheet 24 and a dropped condition hanging from pin 46.

The hinge 41 extends substantially between the sides 22 and 23 and terminates at opposed ends 50 and 51 proximate to the sides 22 and 23, respectively. The ends 50 and 51 are disposed inboard of the sides 22 and 23, respectively, defining gaps 52 and 53 on the underside 26 of the sheet 24. The gap 52 is formed between the end 50 of the hinge 41 and the side 21, and between the framework 30 and the upstream end 21 of the ramp 11. The gap 53 is formed between the end 51 of the hinge 41 and the side 22, and between the framework 30 and the upstream end 21 of the ramp 11. The gaps 52 and 53 define support regions on the underside 26 of the sheet 24 which rest on and are supported by the landing 12.

Returning to FIG. 2, the landing 12 is a platform having a downstream end 60 and an upstream end 61, and sides 62 and 63. The downstream end 60 is opposed and parallel to the side 62, the upstream end 61 is opposed and parallel to the side 63, and the downstream and upstream ends 60 and 61 are transverse with respect to each other. As shown in the embodiment in FIG. 2, the landing 12 has a right-handed configuration, such that pedestrian traffic turns right when moving from the upstream end 61 to the downstream end 60. One having reasonable skill in the art will readily appreciate the landing could alternately be constructed with a left-handed configuration in which a pedestrian or wheelchair turns left when moving from the upstream end 61 to the downstream end 60. For purposes of clarity of discussion, this description will refer to the right-handed configuration unless otherwise specified.

A sheet 64 extends between the downstream end 60 and the side 62, and between the upstream end 61 and the side 63, and includes an upper surface 65 and an underside 66. The sheet 64 is large, rectangular in shape, rugged, and is a walking or rolling surface for supporting pedestrian traffic passing over the ramp assembly 10 between the downstream and upstream ends 60 and 61. The sheet 64 has a thin, flat profile, and is supported across the underside 66 by a rigid, structural framework 70 (shown in FIG. 5A) to prevent flexing of the sheet 64.

Sockets 70, 71, 72, and 73 are mounted to the sheet 64. The sockets 70 and 71 are mounted on the side 63 proximate to the downstream end 60 and the side 62, respectively. The sockets 72 and 73 are mounted to the side 62 proximate to the side 63 and the upstream end 61, respectively. The sockets 70, 71, 72, and 73 are suspended away from the sheet 64 and have openings extending into receiving spaces formed with the sockets 70, 71, 72, and 73, respectively. Each of the sockets 70, 71, 72, and 73 is vertically positioned on the sheet 64 so that the tops of the sockets project above the upper surface 65, locating the openings above the upper surface 65 proximate to the sides 62 and 63. The openings are each square, and the receiving spaces are prismatic and correspond to the square openings.

Figure 6:
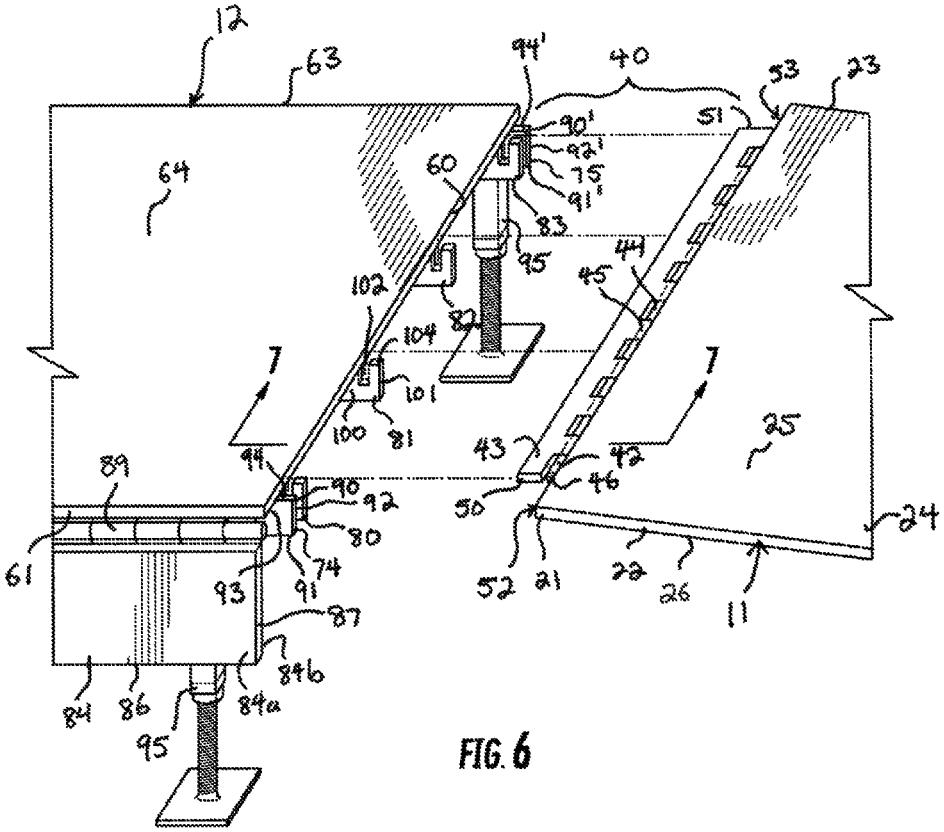
FIG. 6 is a top perspective view of an engagement assembly carried by the ramp and the landing of FIG. 1.

With reference now to FIG. 6, the downstream end 60 of the landing 12 carries the corresponding engagement elements of the engagement assembly 40. The corresponding engagement elements are two studs 74 and 75 and four brackets 80, 81, 82, and 83. The studs 74 and 75 are identical in every respect, other than in location, and as such, only the stud 74 will be described, with the understanding that the discussion equally applies to the stud 75. The features of the stud 75 carry the same reference characters as those of the stud 74, but are denoted with a prime symbol ("") to distinguish the features of the stud 75 from those of the stud 74. The stud 74 has a thin profile and includes a top 90, an opposed bottom 91, a front edge 92, and an opposed rear portion 93. The top 90 of the stud 74 is permanently fixed to the underside 66 of the sheet 64 along the rear portion 93 of the stud 74, as by welding, bolting, or like permanent fastening method. The front edge 92 of the stud 74 projects outward beyond the downstream end 60 of the sheet 64. The portion of the top 90 between the downstream end 60 of the sheet 64 and the front edge 74 defines a support surface 94. The stud 74 is fixed proximate to the upstream end 61. Similar to the stud 74, the stud 75 has a thin profile and includes a top 90', a bottom 91', a front edge 92', a rear portion 93', and a support surface 94. The stud 74 is fixed proximate to the side 63. The studs 74 and 75 are constructed from a material or combination of materials having strong, rugged, durable, and rigid material characteristics, such as metal.

Figure 7A:
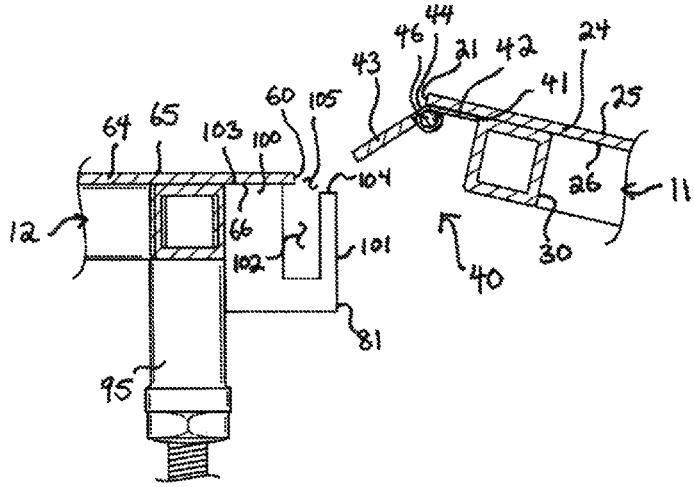
FIGS. 7A-7C are section views taken along the line 7-7 of FIG. 6, showing a sequential series of operational steps for coupling the ramp to the landing to form a continuous walking surface.

The brackets 80, 81, 82, and 83 are identical to each other in every respect, other than in location, and as such, only the bracket 81 will be described. For clarity of the illustration in FIG. 6, the features of the other brackets 80, 82, and 83 will not be specifically identified with reference characters, but it should be understood that the brackets 80, 82, and 83 share those features described below with respect to the bracket 81. The bracket 81 is a thin, projecting piece of strong, rugged, durable, and rigid material, such as metal. As seen in FIG. 7A, the bracket 81 is U-shaped and includes a base 100 and a post 101 mounted to and spaced apart from the base 100 so as to define a slot 102 between the base 100 and the slot 101. The base 100 has a top 103 secured to the underside 66 of the sheet 64. The post 101 has a top 104 disposed just beyond the downstream end 60 and just below the underside 66 of the sheet 64, and is spaced apart from the downstream end 60 so as to form an opening 105 leading into the slot 102. The post 101 is an appendage of the base 100 for supporting the ramp 11 thereon. Although FIG. 6 does not show reference characters, one having skill in the art will readily appreciate that brackets 80, 82, and 83 carry identical features as bracket 81, and as such, each has a base, post, slot, top of the base, top of the post, and an opening leading into the slot. The bracket 80 is located inboard of and spaced apart from the stud 74. The bracket 83 is located inboard of and spaced apart from the stud 75. The brackets 81 and 82 are spaced apart from each other and are located in generally intermediate locations between the brackets 80 and 83, from which the brackets 81 and 82 are spaced apart.

Figure 5A:
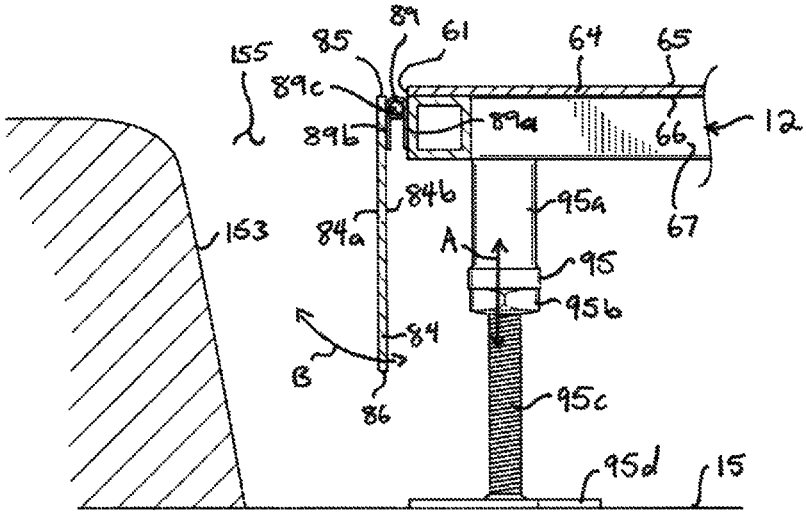
FIGS. 5A and 5B are section views of the landing and the curb taken along the line 5-5 of FIG. 1, showing a bridge on the landing in a lowered position and a raised position, respectively.

The landing 12 includes four feet 95 for adjusting the height of the landing 12. Each foot 95 is identical to the other in every respect, other than location, and as such, each foot is denoted with the same reference characters, and only a single foot 95 will be discussed. With reference now to FIG. 5A, which shows the foot 95 clearly, the foot 95 includes a cylindrical sleeve 95*a* secured to the framework 67 and terminating at a threaded nut 95*b* for threadably receiving a threaded shank 95*c*. The nut 95*b* is brazed, welded, or otherwise permanently mounted to the sleeve 95*a*. The threaded shank 95*c* has a free end disposed within the sleeve 95*a* and an opposing base for placement against the ground or road surface 15. The base 95*d* is flat and broad to provide stability to the foot 95, and the length of the foot 95 can be adjusted by turning the shank 95*c* within the sleeve in a clockwise or counter-clockwise fashion to shorten or lengthen, respectively, the foot 95, so as to raise or lower the landing 12 supported by the foot 95.

With reference now to FIG. 1, the landing 12 is raised or lowered to locate the upper surface 65 of the sheet 64 near the height of a walking surface to which the landing 12 is proximate. A bridge 84 is mounted to the upstream end 61 of the landing 12 for hinged movement. The bridge 84 has a thin, flat profile, and includes a downstream end 85 and an opposed upstream end 86, opposed sides 87 and 88, and has an upper surface 84*a* and opposed underside 84*b*. The downstream and upstream ends 85 and 86 are long and parallel with respect to each other, and are transverse with respect to the sides 87 and 88, which are parallel to each other. The downstream and upstream ends 85 and 86 are longer than the sides 87 and 88, such that the bridge 84 is elongate in shape. The downstream end 85 of the bridge 84 is coupled to and coextensive to the upstream end 61 of the landing 12. A hinge 89 couples the bridge 84 to the landing 12. With reference to FIG. 5A, the hinge 89 is a piano hinge having a leaf 89*a* carried on the framework 67 of the landing 12, an opposed leaf 89*b* carried on the underside 84*b* of the bridge 84, and a pin 89*c* coupling the leaves 89*a* and 89*b*. The bridge 84 is constructed from a material or combination of materials having strong, rugged, durable, and rigid material characteristics, such as metal. The bridge 84 is useful for spanning the distance between the landing 12 and the walking surface proximate to the landing 12.

Returning to FIG. 1 and FIG. 2, the side railing 13 is releasably coupled to the ramp 11 for configuration between an applied condition, shown in FIG. 1, and a free condition, shown in FIG. 2. The side railing 13 includes a downstream end 110 and an opposed upstream end 111, a top rail 112, middle rail 113, and kick plate 114. A grab bar 115, proximate to the downstream end 110, extends between the top rail 112 and the middle rail 113. A front leg 116, proximate to the downstream end 110, a middle leg 117, and a rear leg 118, proximate to the upstream end 111, all extend between the top rail 112 and kick plate 114. The top and middles rails 112 and 113 extend downstream of the front leg 116. The top rail 112, middle rail 113, and kick plate 114 are parallel with respect to each other and transverse with respect to the front, middle, and rear legs 116, 117, and 118, which are parallel to each other. The grab bar 115 is substantially parallel to the front, middle, and rear legs 116, 117, and 118 and inclines downstream slightly from the middle rail 113 to the top rail 112. The side railing 13 is constructed from a material or combination materials have strong, rigid, rugged, and durable material characteristics, such as metal or plastic, and is assembled by welding, bolting, or similar fastening method for permanently and rigidly joining the rail and leg elements of the side railing 13.

The front, middle, and rear legs 116, 117, and 118 terminate in feet 120, 121, and 122, respectively, for fitting into the sockets 31, 32, and 33, respectively, to secure the side railing 13 to the ramp 11 in an upward position, forming a rigid barrier on the ramp assembly 10 along the side 23 of the ramp 11 to prevent pedestrian traffic from falling off the ramp 11 during use. When the side railing 13 is secured to the ramp 11, the grab bar 118 is normal to the upper surface 25 of the sheet 25 to provide a grip to users of the ramp assembly 10 at the downstream end 20 for assistance in moving along the ramp 11.

Figure 2:
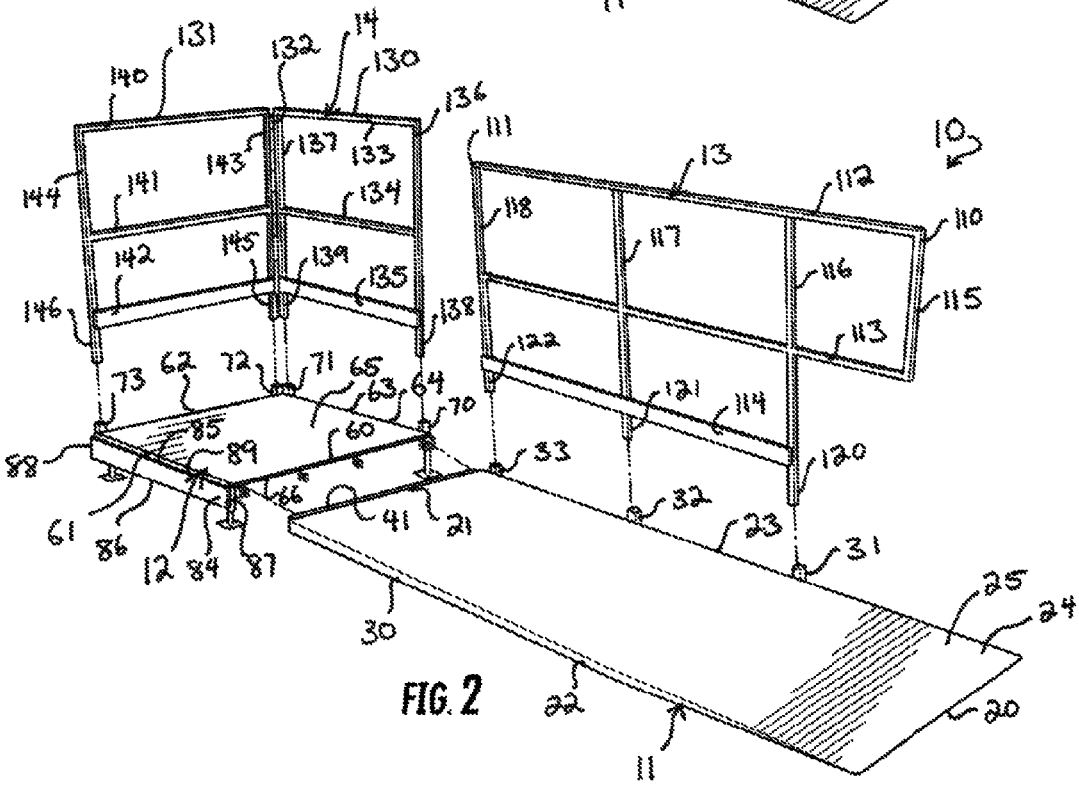
FIG. 2 is a front perspective of the ramp assembly of FIG. 1 shown in a partially disassembled condition.

With continuing reference to FIGS. 1 and 2, the corner railing 14 is releasably coupled to the landing 12 for configuration between an applied condition, shown in FIG. 1, and a free condition, shown in FIG. 2. The side railing includes a side framework 130 and an end framework mounted to each other along a hinge 132 carried between the side and end frameworks 130 and 13, for pivotal movement between an open condition, shown in FIGS. 1 and 2, and a closed or folded position, shown in FIG. 4.

The side framework 130 includes a top rail 133, a middle rail 134, a kick plate 135, an outer leg 136, and an opposed inner leg 137. The top rail 133, middle rail 134, and kick plate 135 are parallel to each other and transverse with respect to the outer and inner legs 136 and 137, which extend between the top rail 133 and kick plate 135, are parallel with respect to each other, and terminate in feet 138 and 139, respectively. The end framework 131 includes a top rail 140, a middle rail 141, a kick plate 142, an inner leg 143, and an opposed outer leg 144. The top rail 140, middle rail 141, and kick plate 142 are parallel to each other and transverse with respect to the inner and outer legs 143 and 144, which extend between the top rail 140 and the kick plate 142, are parallel with respect to each other, and terminate in feet 145 and 146, respectively. The side and end frameworks 130 and 131 are each constructed from a material or combination materials have strong, rigid, rugged, and durable material characteristics, such as metal or plastic, and is assembled by welding, bolting, or similar fastening method for permanently and rigidly joining the rail and leg elements of the side and end frameworks 130 and 131. When the corner railing 14 is in the applied condition with respect to the landing 12, the feet 138 and 139 are applied to the sockets 70 and 71, respectively, and the feet 145 and 146 are applied to the sockets 72 and 73, respectively.

Figure 4:
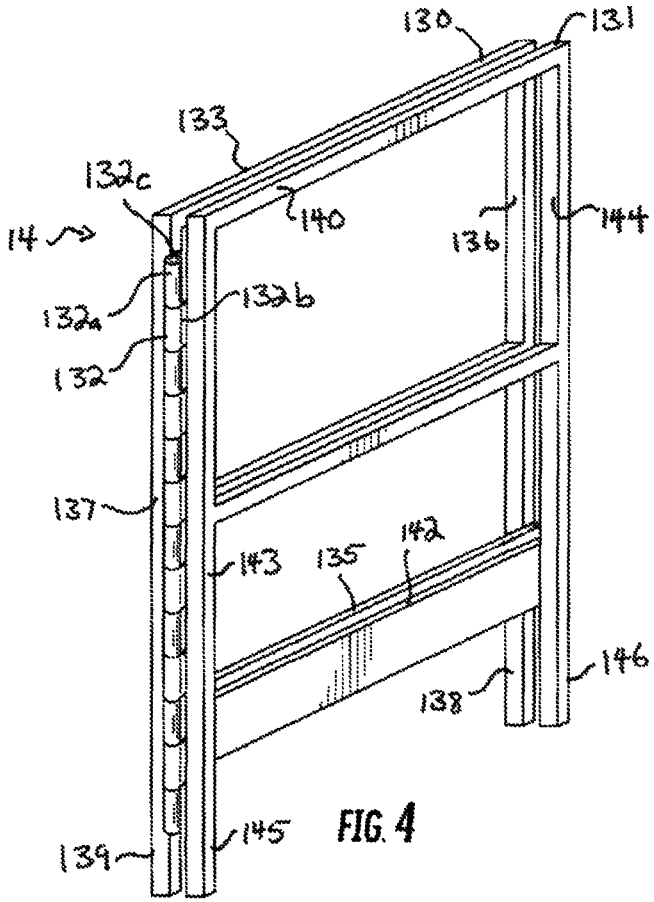
FIG. 4 is a perspective view of the corner railing of FIG. 1.

With reference to FIG. 4, the hinge 132 is carried by the side and end frameworks 130 and 131 on the inner legs 137 and 143, respectively. The hinge 132 extends between the top rails 133 and 140 and the feet 139 and 145. The hinge 132 is a piano hinge, including opposed, enmeshed leaves 132*a* and 132*b* and an axial pin 132*c* coupling the leaves 132*a* and 133*b*.

Figure 3:
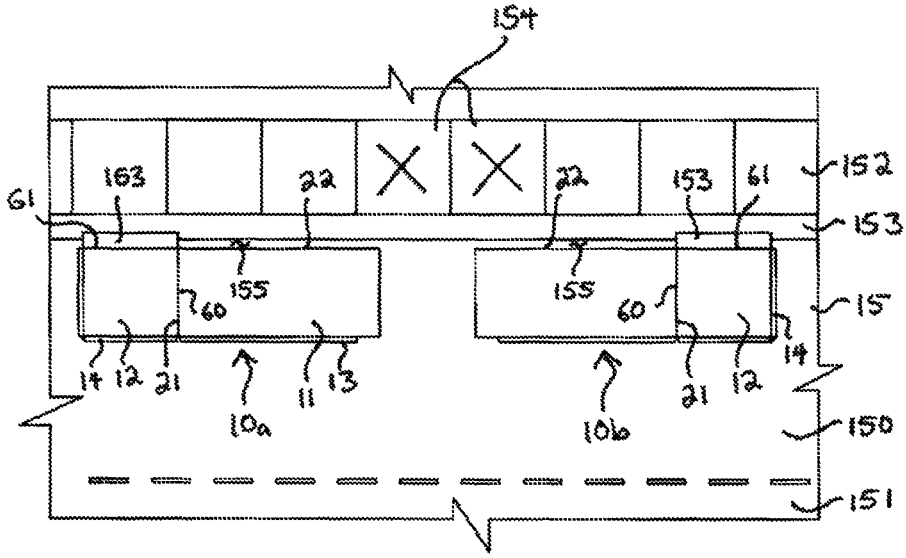
FIG. 3 is a top plan view of a segment of a road having a curb and a sidewalk under construction, with two of the ramp assemblies of FIG. 1 placed proximate to the sidewalk.

In operation, the ramp assembly 10 is useful for detouring pedestrian traffic around construction zones. With reference to FIG. 3, which illustrates a road 15 having two lanes 150 and 151 of traffic, an elevated sidewalk 152, and a curb 153 separating the sidewalk 152 from the road 15, two panels 154 of the sidewalk are under construction. Two ramp assemblies 10, identified here for reference purposes as ramp assembly 10*a* and ramp assembly 10*b*, have been installed in the road 15 on either side of the panels 154 to detour traffic from the sidewalk 152 over the curb 153 and around the panels 154. The ramp assembly 10*a* has a left-handed configuration, and the ramp assembly 10*b* has a right-handed configuration.

The ramp assemblies 10*a* and 10*b* are placed proximate to the curb 153 so that the sides 22 of the ramps 10*a* and 10*b* form gaps 155 between the ramps 11 and the curb 153. Each of the ramps 11 is aligned parallel to the curb 15 with the sides 22 extending along the length of the curb and with the upstream ends 21 of the ramps 11 aligned transversely to the curb 153. In this way, the ramps 11 are arranged out of the lane 150 of traffic, detouring pedestrian traffic around the panels 154 safely away from the lane 150 of traffic.

Figure 5B:
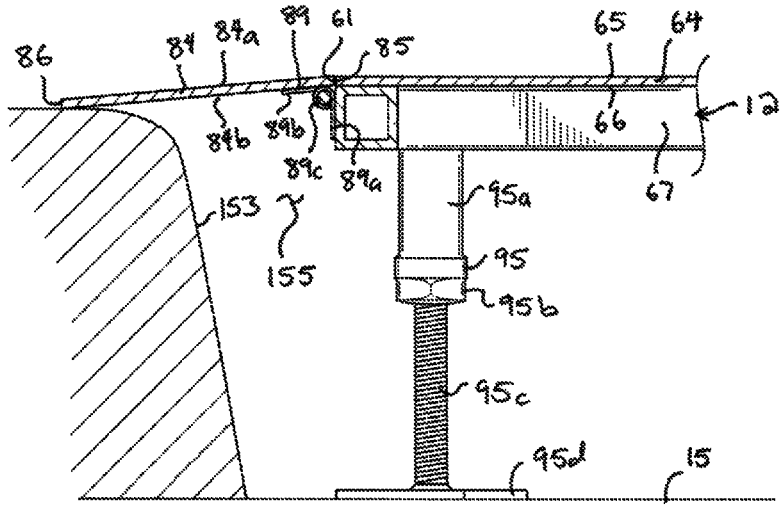

With reference to FIG. 5A, the gap 155 also spaces the landing 12 away from the curb 153. The upstream end 61 of the landing 12 is parallel to and spaced apart from the curb 153, which inclines inwardly away from the road 15. The downstream end of the landing 60 (seen in FIG. 3) is aligned transversely with respect to the curb 153. The bridge 84, mounted to the upstream end 61 of the landing 12, pivots between a lowered position, shown in FIG. 5A, and a raised position, shown in FIG. 5B. In the lowered position, the bridge 84 hangs from the upstream end 61 of the landing 12 in the gap 155. In the raised position, the bridge 84 spans the gap 155 between the landing 12 and the curb 153. The downstream end 85 of the bridge 84 is contiguous with the upstream end 61 of the bridge, and the upper surface 84*a* of the bridge 84 is level with the upper surface 65 of the sheet 64 of the landing 12, so that the bridge 84 defines a continuous extension of the landing 12 to the curb 153, providing a continuous walking surface from the landing 12 to the curb 153.

The ramp assembly 10 is easy to assemble in place. The ramp assembly 10 is stored in the storage condition, in which the ramp 11 is free of the landing 12, and the side and corner railings 13 and 14 are removed from the ramp 11 and landing 12, as shown in FIG. 2. The corner railing 14 is folded about the hinge 132 so that the downstream leg 136 of the side framework 130 is proximate to the upstream leg 144 of the side framework 131, the upstream leg 137 of the side framework 130 is proximate to the downstream leg 145 of the side framework 131, and the kick plates 135 and 142 are in contact against and along each other. In this manner, the corner railing 14 is folded into a flat condition for easy transportation and low storage space. The ramp 11, landing 12, side railing 13, and corner railing 14 are then stacked upon each other for storage. When transported to a construction site, the landing 12 is placed proximate to the curb 153, as shown in FIG. 5A. The legs 95 are each adjusted by turning the threaded shanks 95*c* within the sleeves 95*a* to lengthen or shorten the legs 95 along line A (shown in FIG. 5A) so as to raise or lower, respectively, the landing 12, moving the upper surface 65 of the landing 12 to approximately the same height as the curb 153, as shown in FIG. 5A. The landing is lifted and the bridge 84 is then pivoted about the hinge 89 along arcuate line B to span the gap 155 between the landing 12 and the curb 153, resting the underside 84*b* of the bridge on the curb 153 and forming a continuous walking surface from the landing 12, over the bridge 84, onto the curb 153.

Figure 7B:
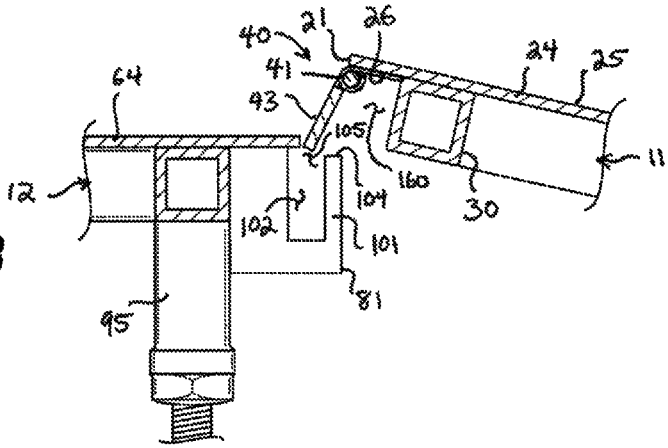
Figure 7C:
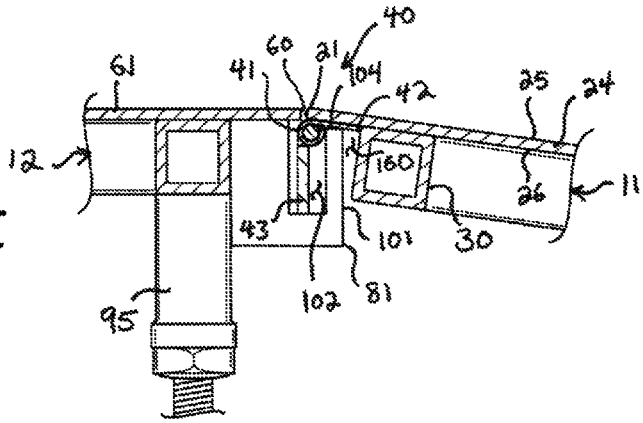

Referring now to FIGS. 7A-7C, with the landing 12 in place, the ramp 11 is coupled to the landing 12. With reference first to FIG. 7A, the ramp 11 is placed alongside and extending from the landing 12, with the upstream end 21 of the ramp 11 directed toward the downstream end 60 of the landing 12. The leaf 43 of the hinge 41 is directed generally away from the upstream end 21 and toward the landing 12. With the downstream end 20 of the ramp 11 resting on the road 15, the upstream end 21 is maneuvered close to the landing 12. The pivotal mounting of the leaf 43 on the hinge 41 provides a flexible, manipulable engagement to the landing 12 which allows the downstream end 20 of the ramp 11 to be positioned at various heights, the upstream end 21 to be secured to the landing 12, and the sheets 24 and 64 to form a continuous walking surface.

Moving to FIG. 7B, the leaf 43 is introduced into the opening 105 leading into the slot 102 of the bracket 81. The leaf 43 is aligned with the orientation of the slot 102, and the top 101 of the bracket 81 is brought closer to the underside 26 of the sheet 24 between the upstream end 21 and the framework 30. The area formed between the upstream end 21 of the ramp 11, the underside 26 of the sheet 24, and the framework 30 defines a receiving area 160 for receiving the post 101. The receiving area 160 accommodates the post 101 in a variety of positions of the ramp 11, when the downstream end 20 of the ramp 11 is much lower than the landing 12, in which the post 101 is in the receiving area 160 and proximate to the framework 30, and when the downstream end 20 of the ramp 11 is level with the landing 12, in which the post 101 is in the receiving area 160 and is spaced apart from the framework 30.

Moving to FIG. 7C, the ramp 11 is now coupled to the landing 12. The leaf 43 is fully received in the slot 102, the post 101 is received within the receiving area 160 proximate to the framework 30, the top 104 of the post 101 is received in contact against the leaf 42 of the hinge 41, and the upstream end 21 of the ramp 11 is spaced apart from the downstream end 60 of the landing 12 by an amount less than the thickness of the sheet 24 between the upper surface 25 and the underside 26, forming a continuous walking surface from the sheet 24 to the sheet 64. One having reasonable skill in the art will readily appreciate that the separation between the upstream end 21 and the downstream end 60 is slight, and lessens in response to arranging the landing 12 and ramp 11 at similar heights. As mentioned before, although FIGS. 7A-7C illustrate the bracket 81, the leaf 43 is similarly received in the bracket 80, 82, and 83. Further, with reference to FIG. 6, it should be understood that when the ramp 11 is coupled to the landing 12, the stud 74 and the stud 75 are received in contact against the underside 26 of the sheet 24 at the gaps 52 and 53, respectively, further supporting the upstream end 21 of the landing 12. The support surfaces 94 and 94; are received in direct contact against the gaps 52 and 53, respectively. The studs 74 and 75 limit lateral movement of the ramp 11 with respect to the landing 12 along line C (as indicated in FIG. 6) that may be urged as pedestrian traffic travels over the ramp assembly 10. The ends 50 and 51 of the hinge 41 are bound in contact by the studs 75 and 75, respectively, limiting movement of the upstream end 21 of the ramp 11 laterally along the upstream end 21, and thus preventing the ramp 11 from dislodging from the landing 12 once coupled thereto. In this way, the studs 74 and 75, and the brackets 80, 81, 82, and 83 firmly and strongly support the ramp 11 and limit movement of the ramp 11 with respect to the landing 12.

With the ramp 11 coupled to the landing 12, the side and corner railings 13 and 14 are then applied to form the assembled ramp assembly 10 in the operational condition. As shown in FIG. 2, the side railing 13 is positioned over the side 23 of the ramp 11, and the legs 120, 121, and 122 are aligned with the sockets 31, 32, and 33 and then applied to the sockets 31, 32, and 33, respectively. The corner railing 14 is unfolded from the storage condition thereof and positioned over the sides 62 and 63 of the landing 12, and the legs 138, 139, 145, and 146 are aligned with the sockets 70, 71, 72, and 73 and then applied to the sockets 70, 71, 72, and 73, respectively, so as to place the ramp assembly 10 in the operational condition shown in FIG. 1. In the operational condition, the ramp assembly 10 is placed on the road 15 proximate to the curb 153, the ramp 11 is coupled to the landing 12, the side railing 13 is coupled to the ramp 11, the corner railing 14 is coupled to the landing 12, and the bridge 84 extends outwardly from the landing 12 and onto the curb 153 to form a continuous walking surface between the road 15 and the sidewalk 152. The ramp assembly 10 is then ready to accept and support pedestrian traffic.

The present invention is described above with reference to a preferred embodiment. However, those skilled in the art will recognize that changes and modifications may be made in the described embodiment without departing from the nature and scope of the present invention. Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. A ramp assembly comprising:

a ramp including a sheet and a framework formed on an underside of the sheet supporting the sheet, the ramp having opposed downstream and upstream ends;

a landing including a downstream end and an upstream end, wherein the downstream end of the landing is coupled to the upstream end of the ramp and is aligned parallel with respect to the upstream end of the ramp, and the upstream end of the landing is aligned transverse with respect to the downstream end of the landing;

a bridge mounted to the upstream end of the landing and extending transversely away from the upstream end of the landing;

a hinge assembly coupling the landing to the ramp, the hinge assembly having a first leaf mounted to the ramp and an opposed second leaf free of the ramp;

a bracket configured to receive the second leaf of the hinge assembly, the bracket carried on the landing;

a post on the bracket disposed in contact with the first leaf to support the ramp, wherein the post defines a slot in the bracket which receives the second leaf and prevents movement of the second leaf in the bracket; and the framework is inboard from the upstream end of the ramp, defining a receiving area formed between the underside of the sheet and the framework, the receiving area configured to receive the bracket on the landing.

2. The ramp assembly of claim 1, wherein the bridge is hinged to the upstream end of landing.

3. The ramp assembly of claim 1, wherein the bridge is elongate and includes opposed upstream and downstream ends and opposed first and second sides, and the upstream ends and downstream ends are longer than the first and second sides.

4. The ramp assembly of claim 1, wherein the hinge assembly pivotably couples the landing to the ramp.

5. The ramp assembly of claim 4, wherein the hinge assembly releasably couples the landing to the ramp.

6. The ramp assembly of claim 1, further comprising opposed studs carried on the landing, the studs bounding in contact the second leaf received in the bracket and limiting lateral movement of the ramp with respect to the landing.

7. A ramp assembly comprising:

a ramp including opposed downstream and upstream ends;

a landing including a downstream end and an upstream end, wherein the upstream end of the landing is aligned transverse with respect to the downstream end of the landing;

a bridge pivoted to the upstream end of the landing and extending transversely away from the upstream end of the landing;

a framework mounted underneath the ramp supporting the ramp, wherein the framework is inboard from the upstream end of the ramp, defining a receiving area formed between the underside of the ramp and the framework, the receiving area configured to receive an engagement assembly for coupling the landing to the ramp;

the engagement assembly includes a hinge having opposed first and second leaves, the first leaf carried on the ramp;

a bracket configured to receive the second leaf and carried on the landing;

a post on the bracket which projects beyond the downstream end of the landing;

the ramp assembly is configurable between an operational condition and a storage condition;

in the operational condition, the engagement assembly couples the downstream end of the landing to the upstream end of the ramp, the upstream end of the landing is aligned transverse with respect to the upstream end of the ramp, and the bridge is pivoted to extend out from the landing transverse with respect to the upstream end of the landing;

in the operational condition, the post on the bracket is disposed in direct contact with the first leaf, supporting the ramp and preventing movement of the ramp with respect to the bracket; and in the storage condition, the upstream end of the ramp is decoupled from the downstream end of the landing, and the bridge is pivoted into the landing.

8. The ramp assembly of claim 7, further comprising:

a side railing; and a corner railing including opposed hinged railings;

wherein in the operational condition of the ramp assembly, the side railing is coupled to the ramp between the upstream and downstream ends of the ramp, and the corner railing is coupled to the landing opposite from the upstream and downstream ends of the landing.

9. The ramp assembly of claim 7, wherein the engagement assembly pivotably and releasably couples the landing to the ramp in the operational condition of the ramp assembly.

10. The ramp assembly of claim 7, wherein the engagement assembly further includes opposed studs carried on the landing, the studs bounding in contact the second leaf received in the bracket and limiting lateral movement of the ramp with respect to the landing.

11. The ramp assembly of claim 7, wherein:

the ramp includes a sheet;

the framework is formed on an underside of the sheet and supports the sheet; and the receiving area is formed between the underside of the sheet and the framework, and is configured to receive the bracket.

12. A ramp assembly comprising:

a ramp including opposed downstream and upstream ends;

a landing including a downstream end and an upstream end, wherein the downstream end of the landing is aligned parallel with respect to the upstream end of the ramp, and the upstream end of the landing is aligned transverse with respect to the downstream end of the landing;

an engagement assembly coupling the landing to the ramp, the engagement assembly includes a hinge having opposed first and second leaves, the first leaf carried on the ramp;

a bracket carried on the landing, the bracket having a post which defines a slot in the bracket;

the slot in the bracket receives the second leaf of the hinge to couple the ramp to the landing, wherein the post is disposed in contact with the first leaf to support the ramp and prevent movement of the ramp;

a framework formed on an underside of the ramp, wherein the framework is inboard from the upstream end of the ramp, defining a receiving area formed between the underside of the ramp and the framework, the receiving area configured to receive the post; and a bridge mounted for pivotal movement to the upstream end of the landing between a lowered position and a raised position extending transversely away from the upstream end of the landing.

13. The ramp assembly of claim 12, wherein a hinge mounts the bridge to the upstream end of the landing.

14. The ramp assembly of claim 12, wherein the bridge is elongate and includes opposed upstream and downstream ends and opposed first and second sides, and the upstream ends and downstream ends are longer than the first and second sides.

15. The ramp assembly of claim 12, wherein the engagement assembly pivotably couples the landing to the ramp.

16. The ramp assembly of claim 15, wherein the engagement assembly releasably couples the landing to the ramp.

17. The ramp assembly of claim 12, wherein the engagement assembly further includes opposed studs carried on the landing, the studs bounding in contact the second leaf received in the slot in the bracket and limiting lateral movement of the ramp with respect to the landing.

* * * * *